US005287642A

United States Patent [19]

Scaramucci

[11] Patent Number: 5,287,642

[45] Date of Patent: Feb. 22, 1994

[54] SAFETY DEVICE FOR TRIGGER MECHANISMS, IN PARTICLAR FOR FIREARMS

[75] Inventor: Sergio Scaramucci, Gallo di Petriano, Italy

[73] Assignee: Benelli Armi S.p.A., Urbino, Italy

[21] Appl. No.: 881,619

[22] Filed: May 12, 1992

[30] Foreign Application Priority Data

Jun. 13, 1991 [IT] Italy ..... MI91A0001632

[51] Int. Cl.[5] ..... F41A 17/80

[52] U.S. Cl. ..... 42/70.08; 42/70.07

[58] Field of Search ..... 42/70.08, 70.01, 70.07; 89/148, 154, 146

[56] References Cited

U.S. PATENT DOCUMENTS

| | | | |
|---|---|---|---|
| 1,367,453 | 2/1921 | Bourdelles | 89/154 |
| 1,401,568 | 12/1921 | Swebilius . | |
| 1,503,568 | 8/1924 | Walther | 89/148 |
| 1,912,403 | 6/1933 | Roemer . | |
| 1,972,763 | 9/1934 | Dutton | 42/70.08 |
| 3,707,796 | 1/1973 | Biefeldt | 42/70.01 |

FOREIGN PATENT DOCUMENTS

| | | | |
|---|---|---|---|
| 386986 | 3/1932 | Belgium . | |
| 523315 | 1/1956 | Belgium | 42/70.08 |
| 888847 | 12/1971 | Canada | 42/70.08 |
| 213805 | 4/1924 | United Kingdom . | |
| 512285 | 8/1939 | United Kingdom | 42/70.08 |

*Primary Examiner*—Stephen M. Johnson

*Attorney, Agent, or Firm*—Amster, Rothstein & Ebenstein

[57] ABSTRACT

In a trigger mechanism for firearms, in particular of the adjustable type for target-shooting pistols, the actuator of the mechanism is constituted by an elastic element (29) which is pivoted to the hammer (23) in an upward position and is pivoted, in a downward position, to an element (39) which can slide on the body (5) of the firearm; by acting on the sliding element, the elastic element is inclined so as to vary the direction of the actuation force with respect to the lever arm formed by the fulcrum (25) of the hammer with the upper pivot (27) of the elastic element. The safety device disengages the trigger from the operation of the firing mechanism.

9 Claims, 3 Drawing Sheets

SAFETY DEVICE FOR TRIGGER MECHANISMS, IN PARTICLAR FOR FIREARMS

FIELD OF THE INVENTION

The present invention relates to a safety device for trigger mechanisms, in particular for firearms.

BACKGROUND OF THE INVENTION

Several types of safety mechanisms are known: some safely devices are adapted to lock the trigger actuation lever assembly; other devices are adapted to place a rigid member in front of the striking mass; still others are adapted to extend the actuation spring.

A common type of safety mechanism, for example, is simply constituted by a safety pin which, in safety position, makes contact with a portion of the trigger in order to prevent any movement thereof, whereas in normal firing position it leaves the trigger free to perform its movements.

This type of safety device has the advantage of being extremely simple from the constructive point of view and of being adaptable to numerous and various firing mechanisms; however, in practice it cannot be used for example in firing mechanisms which provide an adjustment of the trigger, as occurs in target-shooting pistols.

UK Patent No. 213,805 discloses a self-loading pistol having a toggle link interposed between the hammer and the percussion spring. Depressible means operable by the act of gripping the pistol handle are provided to impart an initial movement of the toggle link from a safety position into a ready position. In one embodiment, the percussion spring is oscillable, being accomodated in a casing which is oscillably mounted in the handle.

Due to the complicated firing mechanisms and to the particular operating conditions, target-shooting pistols are normally not provided with a safety mechanism. Safety mechanisms, such as the one described above, would in fact interfere with the extremely sensitive operation of the trigger mechanism.

It is nonetheless advisable to provide a safety mechanism for this type of firearms as well, and this need is now even more strongly felt because of new regulations enforced by some countries.

SUMMARY OF THE INVENTION

The aim of the present invention is to provide a safety device for trigger mechanisms providing adjustments of the trigger, such as for example in target-shooting pistols.

Within the scope of this aim, an object of the invention is to provide a safety device which has no effect on the precise operation of the firearm in firing conditions.

Another important object is to provide a safety device which is extremely simple from the constructive point of view and of course also absolutely reliable.

This aim, these objects and others which will become apparent hereinafter are achieved by a safety device for firing mechanisms, in particular for firearms, comprising a trigger, a striking mass pivoted to the body of the firearm by means of a first pivot, and an elastic firing element which has a first end associated with said striking mass by means of a second pivot and a second end associated with said body of the firearm by means of a third pivot; said striking mass having at least two positions: a first cocking position and a second percussion position; said elastic element acting on said second pivot with a force having a component adapted to actuate said striking mass in order to move it from said cocking position to said percussion position; wherein said third pivot of said elastic element can substantially controllably slide on said body so as to move the position of at least said third pivot with respect to said first pivot, defining a third safety position wherein said component of said force is at least cancelled.

BRIEF DESCRIPTION OF THE DRAWINGS

Further characteristics and advantages will become apparent from the description of a preferred but not exclusive embodiment of the invention, illustrated only by way of nonlimitative example in the accompanying drawings, wherein.

DETAILED DESCRIPTION

Figure 1:
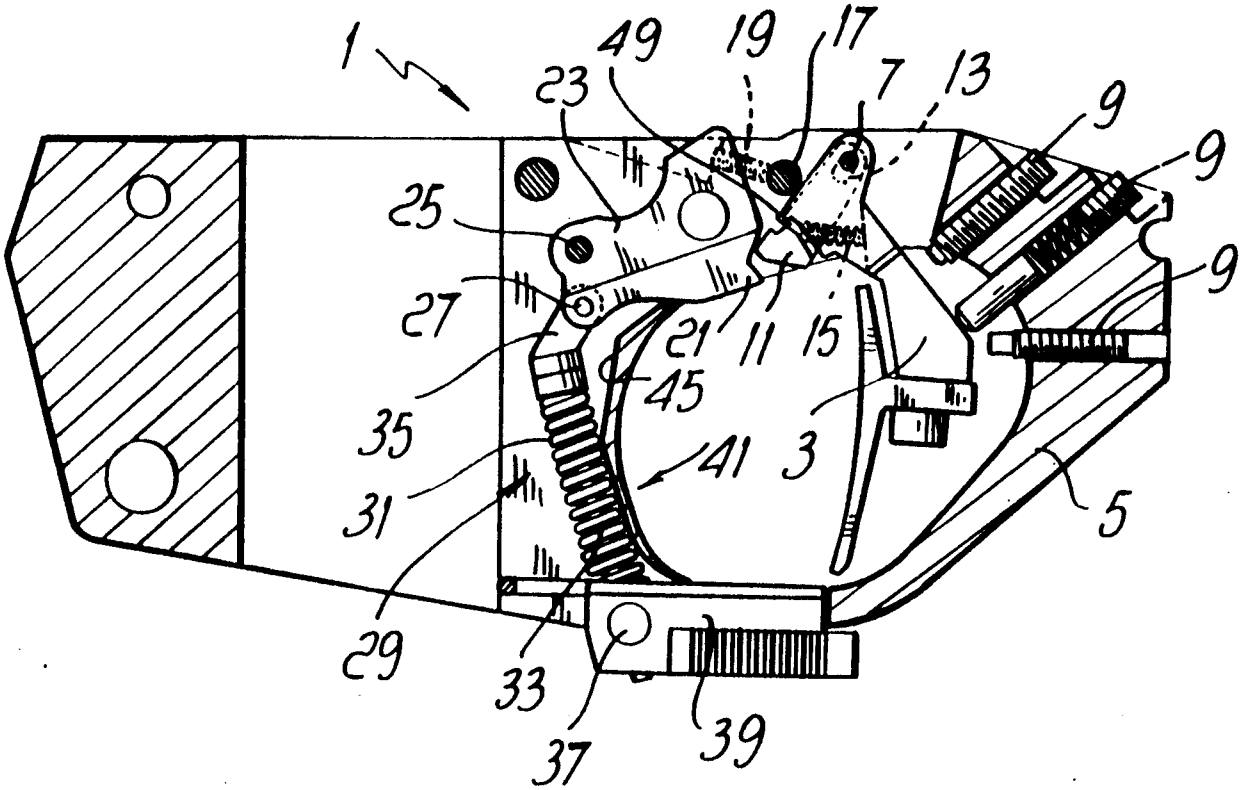
FIG. 1 is a sectional side view of a trigger assembly provided with a safety device according to the invention, in safety position.

With reference to the above figures, the safety device is shown applied to a firing mechanism 1, particularly usable in a target-shooting pistol.

The firing mechanism 1 in fact comprises a trigger 3 which is pivoted to the body 5 of the pistol by means of the pivot 7 and is provided with the conventional adjustment elements, generally indicated by the reference numeral 9.

The trigger 3 furthermore has an engagement tooth 11 which is connected to the fulcrum 7 by means of a slot 13 so as to rotate and slide, with respect to said trigger, by virtue of the action of a spring 15.

The trigger 3 normally abuts on the stop element 17, which is advantageously constituted by a cam which can be adjusted and locked by means of the locking screw 19.

Figure 2:
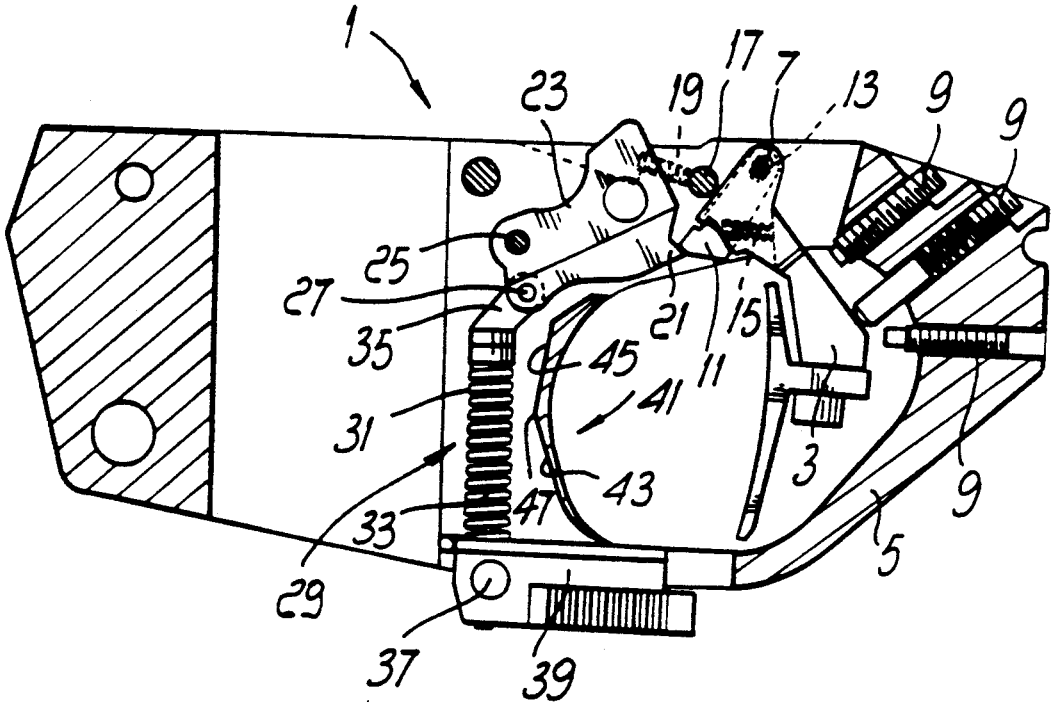
FIG. 2 is a view, similar to the preceding one, of the assembly in the cocking position.

In the cocking condition, illustrated in FIG. 2, the engagement tooth 11 is superimposed on the firing tooth 21 of the striking mass or hammer 23. The superimposition of the engagement tooth on the firing tooth can be adjusted by means of the rotation of the cam 17 on which the trigger 3 abuts.

The hammer 23 is pivoted to the body 5 by means of a first pivot 25 and has a second pivot 27 connected to an elastic element 29. Elastic element 29 constitutes the actuator of the firing mechanism.

Figure 3:
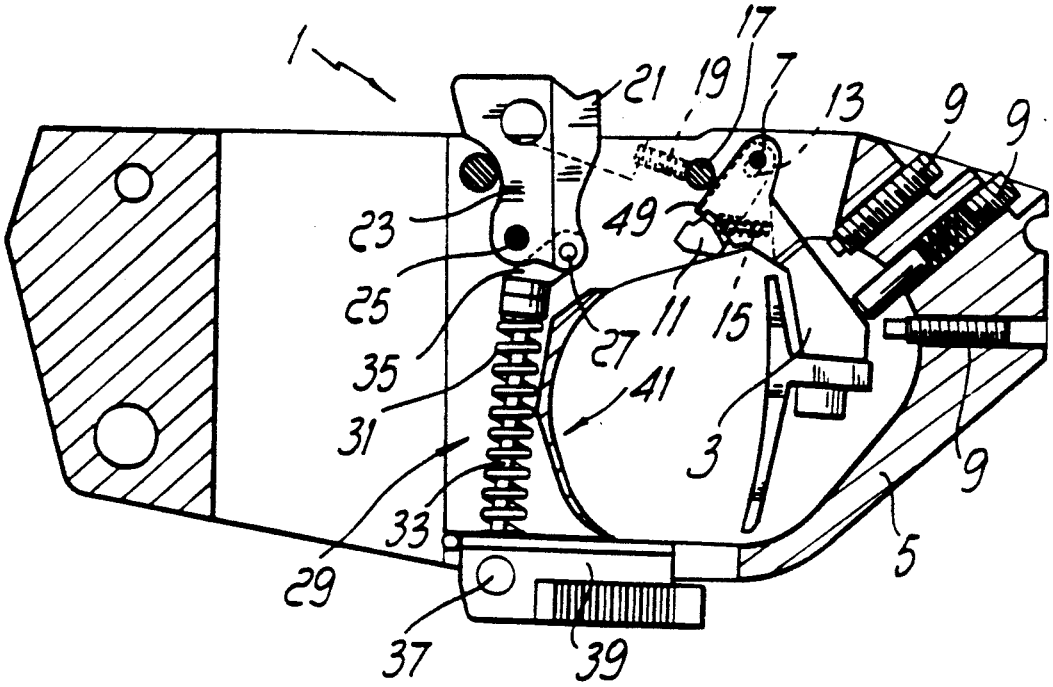
FIG. 3 is a view, similar to the preceding ones, of the assembly in the percussion position.

The elastic element 29 comprises in particular a cylindrical helical percussion spring 31 coaxial to a spring guide pin 33. Pin 33 has an upper lever-shaped end 35 associated with pivot 27. The lower end of the spring guide pin 33 is associated with a third pivot 37. Third pivot 37 is rigidly associated with an element 39 which can slide on the body 5 in two positions: a firing position, illustrated in FIGS. 2 and 3, and a safety position, illustrated in FIG. 1.

Advantageously, a supporting element is defined in the inner median part of the guard 41 and is constituted by two surface portions 43 and 45 connected at the point 47 according to a selected angle.

The supporting element 43, 47 supports the elastic element 29 when the elastic element is moved from the firing position to the safety position, as described hereinafter.

FIG. 2 is a view of the firing mechanism in the cocking position, wherein the engagement tooth 11 overlaps the firing tooth 21 of the hammer 23 by a certain length which can be adjusted by the user by acting on the cam 17.

By actuating the trigger 3, the engagement tooth disengages from the firing tooth allowing the hammer 23 to rotate (counterclockwise with reference to the figures) and to move to the percussion position (illustrated in FIG. 3) due to the force imparted by the elastic element 29.

Figure 4:
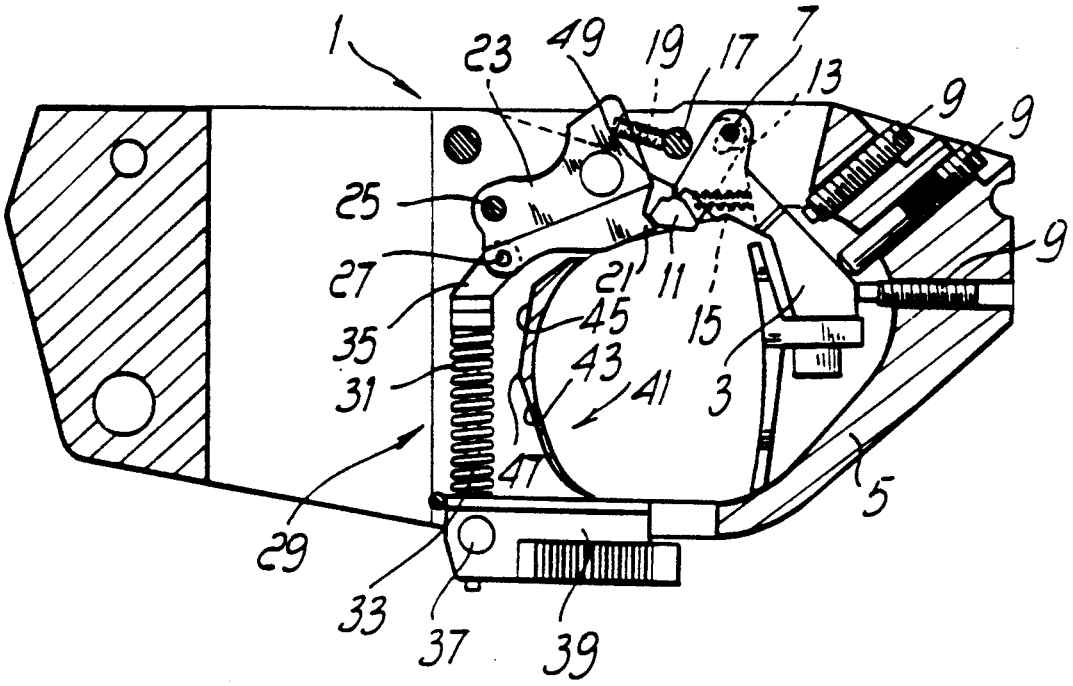
FIG. 4 is a view, similar to the preceding ones, of the assembly in the position for automatic re-cocking and for safety engagement.

In the case of semiautomatic firearms, the bolt recocks automatically and the hammer moves to a recocking position, illustrated in FIG. 4. The engagement tooth 11, no longer engaged by the firing tooth, has in the meantime slid downward, because of the action of spring 15, and interferes with the tooth 49 of the trigger, thus locking the return motion of the hammer, and preventing it from moving back to the percussion position due to the force exerted by the elastic element 29, if the user has kept the trigger pressed.

By releasing the trigger, the firing mechanism moves back to the cocking position, illustrated in FIG. 2, and the firearm is ready to fire again.

At this point, in order to place the firing mechanism in the safety position it is sufficient to act on the sliding element 39, moving it to the position illustrated in figure 1; by means of this operation, the elastic element 29 is inclined so that the component which is perpendicular to the lever arm, defined between the first pivot 25 and the second pivot 27, tends to rotate the hammer in the direction opposite to the percussion direction (therefore clockwise with reference to the figures).

Advantageously, the supporting element 43, 47 interferes with the movement of the elastic element so as to cause the second pivot 27 to advance without having to move the third pivot 37 backward excessively, thus limiting the required stroke of the sliding element 39.

It is apparent that in the safety position the trigger is completely disengaged from the operation of the firing mechanism.

Figure 5:
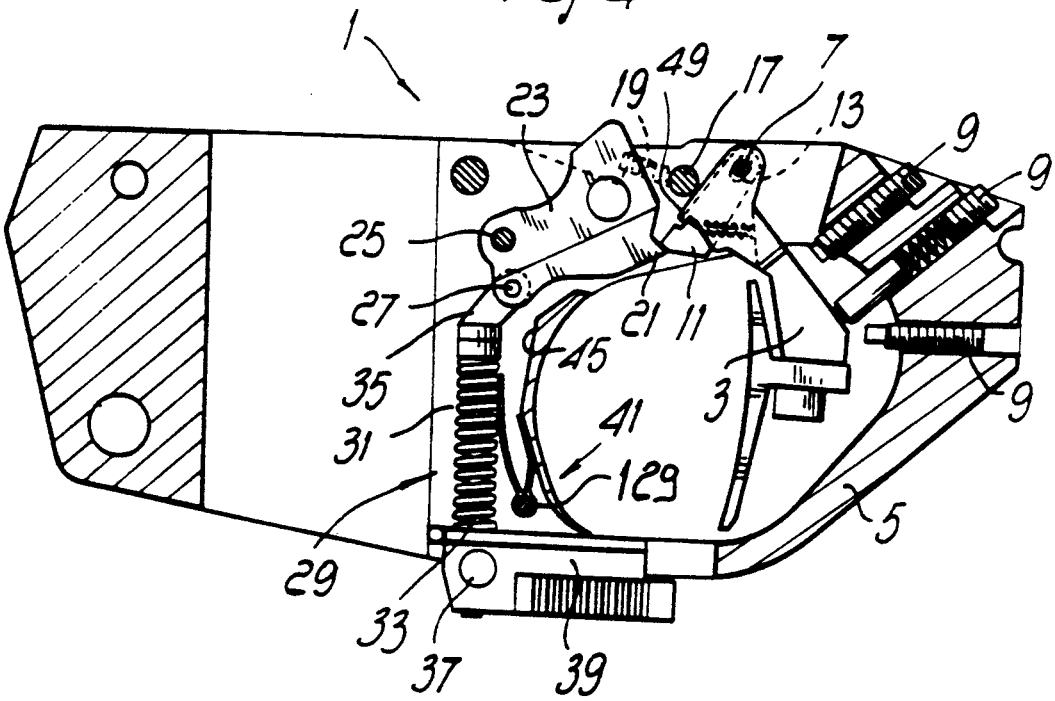
FIG. 5 is a view, similar to the one of FIG. 2, of the assembly according to a further aspect of the invention.

FIG. 5 illustrates a further embodiment of the safety device according to the invention, comprising a second elastic element. The second elastic element is constituted for example by a leaf spring 129 arranged between the elastic element 29 and the inner portion of the guard 41. When the sliding element 39 is moved into the safety position, similarly to what has been described above, the leaf spring is loaded and acts on the elastic element so that on the pivot 27 there is a component for rotating in the direction opposite to the hammer percussion direction.

In this manner it is possible to limit the stroke of the sliding element 39 to the minimum extent required to cancel the component for rotation in the hammer percussion direction, whereas the second elastic element 129 provides a component in the opposite direction which pushes the hammer into a safety position.

It has been observed in practice that the invention achieves the intended aim and objects by providing a safety device which is constructively simple and independent of the operation of the trigger.

The device is extremely reliable, since it acts directly on the striking mass, bypassing the trigger completely.

An important advantage of the safety device according to the invention is that it does not complicate the construction of the firing mechanism, to the full advantage of weight and manufacturing cost, and that it furthermore has a simple and easily understandable operation.

The device according to the invention is susceptible to numerous modifications and variations, all of which are within the scope of the inventive concept; all the details may furthermore be replaced with technically equivalent elements.

The materials employed, as well as the dimensions, may naturally be any according to the requirements and to the state of the art.

I claim:

1. Safety device for trigger mechanisms for firearms having a body comprising a trigger, a striking mass pivoted to the body of the firearm by means of a first pivot, a sliding element slidably formed on the firearm body, and an elastic firing element having a first end associate with said striking mass by means of a second pivot, a second end associated with the firearm body by means of a third pivot, and a generally longitudinal axis between said ends; said striking mass having at least two positions; a first cocking position and a second percussion position; said elastic element being directly and rigidly secured to said second pivot and acting on said second pivot with a force, said force having a component adapted to actuate said striking mass in order to move it in a percussion direction from said cocking position to said percussion position; wherein said third pivot of said elastic element is disposed on said sliding element and can substantially controllably slide on the firearm body so as to re-position at least said third pivot with respect to said first pivot and vary the angle formed by the axis of said elastic element and said component of said force; thereby defining a safety position of said elastic element wherein said component of said force is at least cancelled, said elastic element resting on said sliding element during transfer from said cocking position to said safety position.

2. Device according to claim 1, wherein, in said safety position of said elastic element said component of said force of said elastic element is such as to act on said striking mass, rotating it in a direction which is opposite to the percussion direction.

3. Device according to claim 1, wherein said third pivot is rigidly associated with said sliding element, said sliding element sliding in a guide defined in the firearm body, said sliding element being actuatable from outside in order to move said elastic element selectively from and into said safety position.

4. Device according to claim 1, wherein said elastic element comprises a cylindrical helical spring, said first end of said elastic element being associated with said second pivot by means of a lever element.

5. Device according to claim 4, wherein in said cocking position said spring is in a substantially vertical position, said second pivot being in an upper position, said third pivot being in a lower position, said second pivot being furthermore in a position which is substantially displaced backward with respect to said first pivot; and in said safety position, said spring is in a substantially oblique position, said third pivot being in a rearward position relative to said second pivot, said second pivot being in a position which is substantially displaced forward with respect to a line connecting said first and third pivots.

6. Device according to claim 1, including a guard element arranged in front of said trigger, said sliding element comprising at least one supporting surface defined in a portion of said guard facing said trigger.

7. Device according to claim 6, wherein said supporting surface is formed by two substantially planar surface portions, said planar surface portions forming an angle with respect to one another.

8. Device according to claim 6 including a second elastic element adapted to act, in said safety position, on said second pivot so as to generate a component or force for rotating said striking mass in the direction opposite to the percussion direction, and wherein said second elastic element comprises a leaf spring associated with the firearm body in a position intermediate said elastic firing element and said guard element.

9. Device according to claim 1, including a second elastic element adapted to act, in said safety position, on said second pivot so as to generate a component of force for rotating said striking mass in the direction opposite to the percussion direction.

* * * * *